US010251474B2

(12) United States Patent
Mizrachi

(10) Patent No.: US 10,251,474 B2
(45) Date of Patent: Apr. 9, 2019

(54) PAINT BRUSH EDGING TOOL WITH SWIVEL END PLATE

(71) Applicant: Refael Mizrachi, Lauderhill, FL (US)

(72) Inventor: Refael Mizrachi, Lauderhill, FL (US)

( * ) Notice: Subject to any disclaimer, the term of this patent is extended or adjusted under 35 U.S.C. 154(b) by 0 days.

(21) Appl. No.: 15/629,030

(22) Filed: Jun. 21, 2017

(65) Prior Publication Data

US 2018/0078032 A1 Mar. 22, 2018

Related U.S. Application Data

(63) Continuation-in-part of application No. 15/269,373, filed on Sep. 19, 2016.

(51) Int. Cl.

| | |
|---|---|
| ***A46B 17/08*** | (2006.01) |
| ***B44D 3/22*** | (2006.01) |
| ***A46B 17/00*** | (2006.01) |
| ***A46B 15/00*** | (2006.01) |

(52) U.S. Cl.

CPC ..... *A46B 17/08* (2013.01); *A46B 15/0055* (2013.01); *A46B 17/00* (2013.01); *B44D 3/225* (2013.01); *A46B 2200/202* (2013.01)

(58) Field of Classification Search

CPC ..... A46B 15/00; A46B 17/00; A46B 17/04; A46B 17/08; A46B 2200/202; A46B 2200/205; B44D 3/00; B44D 3/22; B44D 3/205; B05C 17/00; B05C 17/10; B05C 17/12; B05C 21/00; B05C 21/005

USPC ..... 15/166, 246, 248.1

See application file for complete search history.

(56) References Cited

U.S. PATENT DOCUMENTS

| | | | | |
|---|---|---|---|---|
| 499,842 | A * | 6/1893 | Long | 15/248.1 |
| 782,530 | A | 2/1905 | Swanson | |
| 1,927,962 | A * | 9/1933 | Tamplin | A46B 17/08 15/166 |
| 2,584,504 | A | 2/1952 | Seeber | |
| 2,791,790 | A * | 5/1957 | Cooley | B44D 3/225 15/146 |
| 2,820,237 | A | 2/1958 | Maslaney | |
| 2,821,734 | A * | 2/1958 | Carrabine | B44D 3/225 15/248.1 |
| 3,049,741 | A | 8/1962 | Bessette et al. | |

(Continued)

FOREIGN PATENT DOCUMENTS

| | | |
|---|---|---|
| GB | 883328 | * 11/1961 |
| GB | 2012577 | * 8/1979 |
| GB | 2225528 | * 6/1990 |

*Primary Examiner* — Mark Spisich
(74) *Attorney, Agent, or Firm* — Robert C. Kain, Jr.

(57) ABSTRACT

The paint brush guide with swivel mounted secondary guide plate has handle clip or strap to removably attach to the brush handle. First and second elevated plates are disposed above and at an acute angle from the 3-D paint brush plane. A swivel mounted secondary guide plate on the second elevated plate has a distal guide edge operable in first and second guide positions, defined as first and second extreme obtuse cut-in angles for the paint brush. These first and second cut-in angles are on opposite sides of the longitudinal centerline of the paint brush. Further, the first and second elevated plates are longitudinally twisted or rotated over the 3-D brush plane. The second elevated plate form an A-shape forward edge. A hinge between the first and second elevated plates permit flexation. Stops can limit the rotation of the swivel mounted secondary guide plate.

9 Claims, 7 Drawing Sheets

(56) References Cited

U.S. PATENT DOCUMENTS

| | | | | | |
|---|---|---|---|---|---|
| 3,210,791 | A | | 10/1965 | Rogholt | |
| 3,337,894 | A | * | 8/1967 | Compton, Jr. | A46B 17/08 15/166 |
| 3,341,879 | A | | 9/1967 | Kumpman | |
| 3,401,418 | A | | 9/1968 | Deck et al. | |
| 3,462,789 | A | * | 8/1969 | Seal | B44D 3/123 118/504 |
| 3,930,278 | A | | 1/1976 | Nasca | |
| 4,004,318 | A | * | 1/1977 | Balkus, Jr. | A46B 17/08 15/248.1 |
| 4,339,837 | A | | 7/1982 | Reeberg | |
| 4,705,418 | A | * | 11/1987 | van Wesenbeeck | A46B 17/08 15/166 |
| 6,163,920 | A | * | 12/2000 | Meyer | A46B 17/08 15/246 |
| 9,549,608 | B1 | * | 1/2017 | Emery | B05C 17/0222 |
| 2003/0196286 | A1 | | 10/2003 | Pyles | |
| 2013/0022386 | A1 | | 1/2013 | Gallardo | |
| 2015/0223593 | A1 | | 8/2015 | Sguera | |

* cited by examiner

PAINT BRUSH EDGING TOOL WITH SWIVEL END PLATE

This is a continuation-in-part patent application claiming the benefit of patent application Ser. No. 15/269,373, filed Sep. 19, 2016, the contents of which is incorporated herein by reference thereto.

The present invention relates to a patent brush tool which is used in connection with a paint brush and enables the user to easily cut in a painted edge between intersecting walls or intersecting walls and moldings. Also, the edging tool with a swivel end plate permits the user to easily cut in a painted edge from different brush-to-wall angles.

BACKGROUND OF THE INVENTION

It is well-known that cutting in an edge between two interfacing wall surfaces or between the interface between a wall and molding is difficult. A user typically dips his or her paint brush into the paint and attempts to paint a straight line along a considerable length, typically more than 2-3 feet (more than 1 m). During this activity, the edge of the brush may wobble thereby painting an edge that is not straight. The present invention solves this problem.

U.S. Pat. No. 3,210,791, an Edger Attachment for Paint Brushes, discloses an edger attachment that includes a shielding plate pivotally mounted on a paint brush for movements between an operative position for guiding the bristle end portions of the brush and an inoperative position away from the bristles of the brush.

U.S. Pat. No. 3,930,278, a Paintbrush and Guard Attachment for Edging, discloses a device for removable attachment to a paintbrush to assist in cutting-in one flat surface to another. It is formed of a flat metal sheet having a "foot" and a pair of bendable arms that can be bent to engage the opposite sides of the handle of a paintbrush, while the "foot" portion acts as a guide and shield against unintentional smearing.

U.S. Patent Published Application No. 2015/5223593, a Novel Paint Brush with Built In Edger, discloses a paint brush with a built in edger system that aims to control the application of paint and purportedly eliminates the need to use masking tape. The edger system is attached to the brush as a mechanical attachment. The edging device aims to prevent paint from going beyond the borders of the edging device.

U.S. Pat. No. 782,53, a Paint Brush, discloses a paint brush with an attachment in the form of a guard or shield. The shield is able to retract to expose the bristles of a brush and then readily extended to cover the brush, as needed.

U.S. Pat. No. 3,049,741, a Paint Brush Guide, discloses a paint brush guide to attach to a paint brush in order to guide the brush along a window casing or frame.

U.S. Pat. No. 3,341,879, a Paint Brush Edging Attachment, discloses another form of an edging attachment.

Additional prior art paint tools are disclosed at U.S. Pat. Nos. 2,584,504; 2,820,237; 3,401,418; and 4,339,837; and U.S. Patent Application Publication Nos. 2003/196286; and 2013/022386.

OBJECTS OF THE INVENTION

It is an object of the invention to provide an edging tool that can be removably attached to a paint brush handle.

It is a further object of the present invention to provide an edging tool which permits the user to gather paint at the terminal end of the paint brush bristles without placing paint on the distal terminal edge of the edging tool.

It is another object of the invention to provide an edging tool that primarily has elevated shields or plates which extend outboard and away from the three dimensional bristle plane.

It is an additional object of the present invention to provide an edging tool with a swivel end plate which permits the user to easily cut in a painted edge from different brush-to-wall angles. For example, holding the inventive paint brush in one's right hand and to paint an edge between a vertical sidewall and a ceiling, when the sidewall is adjacent the user's left shoulder, the swivel end plate can be placed in one extreme obtuse cut-in angle (a first extreme obtuse cut-in angle which presents the to the wall or ceiling an extreme acute guide edge (the variable angle, forward terminal edge)). When the sidewall is adjacent the user's right shoulder, the swivel end plate can be placed in the other extreme obtuse cut-in angle (presenting to the wall or ceiling the second extreme acute guide edge with the variable angle forward terminal edge).

SUMMARY OF THE INVENTION

A paint brush tool adapted to be removably attached to a handle on a paint brush wherein the paint brush has a handle, a bristle box longitudinally and laterally extending from the handle and paint brush bristles extending both longitudinally outboard beyond the bristle box. The bristles, both longitudinally and laterally form a three dimensional (3-D) solid bristle brush plane. The tool includes a guide having a proximal attachment member attached to the handle. The guide has a stabilization plate adapted to be disposed substantially on and adjacent the handle proximal to the interface between the handle and the bristle box. The stabilization plate may extend to be adjacent the bristle box of the brush. In one embodiment, the guide has a first elevated plate above the stabilization plate at a rise rate of about 1 inch per foot. In another embodiment, the guide has a lateral, substantially perpendicular riser wall elevating a first elevated plate above the stabilization plate. The first elevated plate extends longitudinally beyond the stabilization plate, rises above the stabilization plate at an acute angle, about 15 degrees and is rotated in a roll manner about 30 degrees form the longitudinal centerline of the 3-D bristle brush plane. The first elevated plate is disposed at an acute angle away from the 3-D brush plane and extends at an angle away from and outboard of the 3-D brush plane. The tool includes a forward elevated terminal plate (sometimes called the "second" elevated plate) longitudinally extending beyond a distal edge of the first elevated plate. A distal edge of the terminal plate is adapted to extend longitudinally beyond a distal terminal edge of the 3-D brush plane. The forward or second terminal plate is disposed at an obtuse angle away from the first elevated plate such that the distal terminal plate edge both extends longitudinally beyond the 3-D brush plane and lies substantially adjacent a facing region of the 3-D brush plane. The first elevated plate and the forward or second terminal plate are adapted to be elevated over, spaced apart from and to cover the facing region of the 3-D brush plane. The first and second elevated plates are rotated at an acute angle about a longitudinal centerline of the 3-D brush plane away from the 3-D brush plane about 15-30 degrees from the 3-D plane.

As a result, the user is enabled to gather paint on the 3-D brush plane without placing paint on the forward or second terminal plate. Also, the distal edge of the forward terminal plate rides along the wall-to-wall corner (or wall-to-molding corner) thereby guiding the brush in a straight line.

Further features of the tool include a hinge at the interface of the first elevated plate and the forward or second terminal plate thereby permitting the terminal plate to flex towards and away from the first elevated plate as needed by the user. The tool has a stabilization plate, a riser, a first elevated plate and a terminal plate as a one-piece, integral structure. The hinge may be formed by a thin walled interface between the first elevated plate and the terminal plate. The thinner interface wall establishes a flexible joint between the first elevated plate and the terminal plate.

The paint tool may have a bristle box and the 3-D brush plane which respectively have a predetermined box length and width and a predetermined 3-D brush plane length and width. The first elevated plate and the terminal plate have lengths and widths which complement and cover the predetermined box length and width and predetermined 3-D brush plane length and width.

The 3-D brush plane has a terminal brush edge which may be angular with respect to a longitudinal aspect of the 3-D brush plate. In this case, the terminal plate has a distal terminal edge which is angular with respect to a longitudinal aspect of the terminal plate and which is complementary to the terminal brush edge.

In another embodiment, the paint brush tool is removably attached to a handle on a paint brush. The tool includes a guide having a proximal handle clip or handle strap adapted to be removably attached to the handle. The guide has a first elevated plate coupled to the handle clip or handle strap and extends longitudinally away from the handle. The first elevated plate is disposed at an acute angle away from the 3-D brush plane and extends at an angle away from and outboard of the 3-D brush plane. A second elevated plate longitudinally extends beyond a distal edge of the first elevated plate. A swivel mounted secondary guide plate is movably mounted on the second elevated plate at or near both a longitudinal centerline of the second elevated plate and the longitudinal centerline of the paint brush. The secondary guide plate has a distal secondary guide terminal edge. The secondary guide terminal edge is operable in at least a first and a second guide position. In the first guide position, the secondary guide terminal edge forms a first extreme obtuse cut-in angle for the paint brush. In the second operational position, the secondary guide terminal edge forms a second extreme obtuse cut-in angle for the paint brush. The first and second extreme obtuse cut-in angles are measured relative to or with respect to the longitudinal centerline of the paint brush. These first and second extreme obtuse cut-in angles are on opposite sides of the longitudinal centerline of the paint brush. An outboard surface of the second elevated plate is disposed at an obtuse angle away from an outboard surface of the first elevated plate. The second elevated plate extends over both the 3-D brush plane. The secondary guide terminal edge, while in the first and second operational positions, is elevated over and spaced apart from a terminal brush facing region of the 3-D brush plane. The first and second elevated plates are longitudinally twisted and rotated at an acute angle with respect to a longitudinal centerline of the 3-D brush plane. As a result, the user can gather paint on the bristles in the 3-D brush plane and gather paint on the terminal brush facing region without placing paint on the secondary guide plate.

Further enhancements of the guide with the swivel mounted secondary guide plate are discussed herein. The second elevated plate longitudinally extends beyond a distal edge of the first elevated plate. Also, the second elevated plate may have a pair of terminal edges forming a terminal vertex above the 3-D brush plane. Stated otherwise, this vertex may form an A-shape forward edge region on the second elevated plate. Other two-sided, arrow shaped forms may be created at the terminal ends of the second elevated plate. However, the terminal ends of the second elevated plate should form an acute angle with respect to each end. In these situations, the secondary guide plate is rotatably mounted near the terminal vertex. The distal endpoint of the vertex can either (a) be co-extensive with the distal terminal edge of the 3-D brush plane or (b) extend longitudinally beyond the distal terminal edge of the 3-D brush plane.

The paint tool can include a hinge along an interface between the first elevated plate and the second elevated plate thereby permitting the second elevated plate to flex with respect to the first elevated plate. The hinge can be formed as a detent along the interface between the first elevated plate and the terminal plate. The detent establishes a flexible joint between the first elevated plate and the second elevated plate.

Further, the paint tool can include first and second stops respectively limiting the rotation of the secondary guide plate at (a) the first operational position for the first extreme obtuse cut-in angle and (b) the second operational position at the second extreme obtuse cut-in angle. The stops may be tabs on the secondary guide plate coacting with the terminal edges of the second elevated plate, or raised lands on the secondary guide plate coacting with detents on the second elevated plate, or raised lands on the second elevated plate coacting with detents on the secondary guide plate. Other mechanical stops can be used.

BRIEF DESCRIPTION OF THE DRAWINGS

Further objects and advantages of the present invention are found in the detailed description of the preferred embodiments when taken in conjunction with the drawings which are briefly described below.

DETAILED DESCRIPTION OF THE PREFERRED EMBODIMENTS

The present invention relates to a paint brush tool and, more specifically, an edging tool which is removably mounted onto a paintbrush. Similar numerals designate similar items throughout the Figures.

Figure 1:
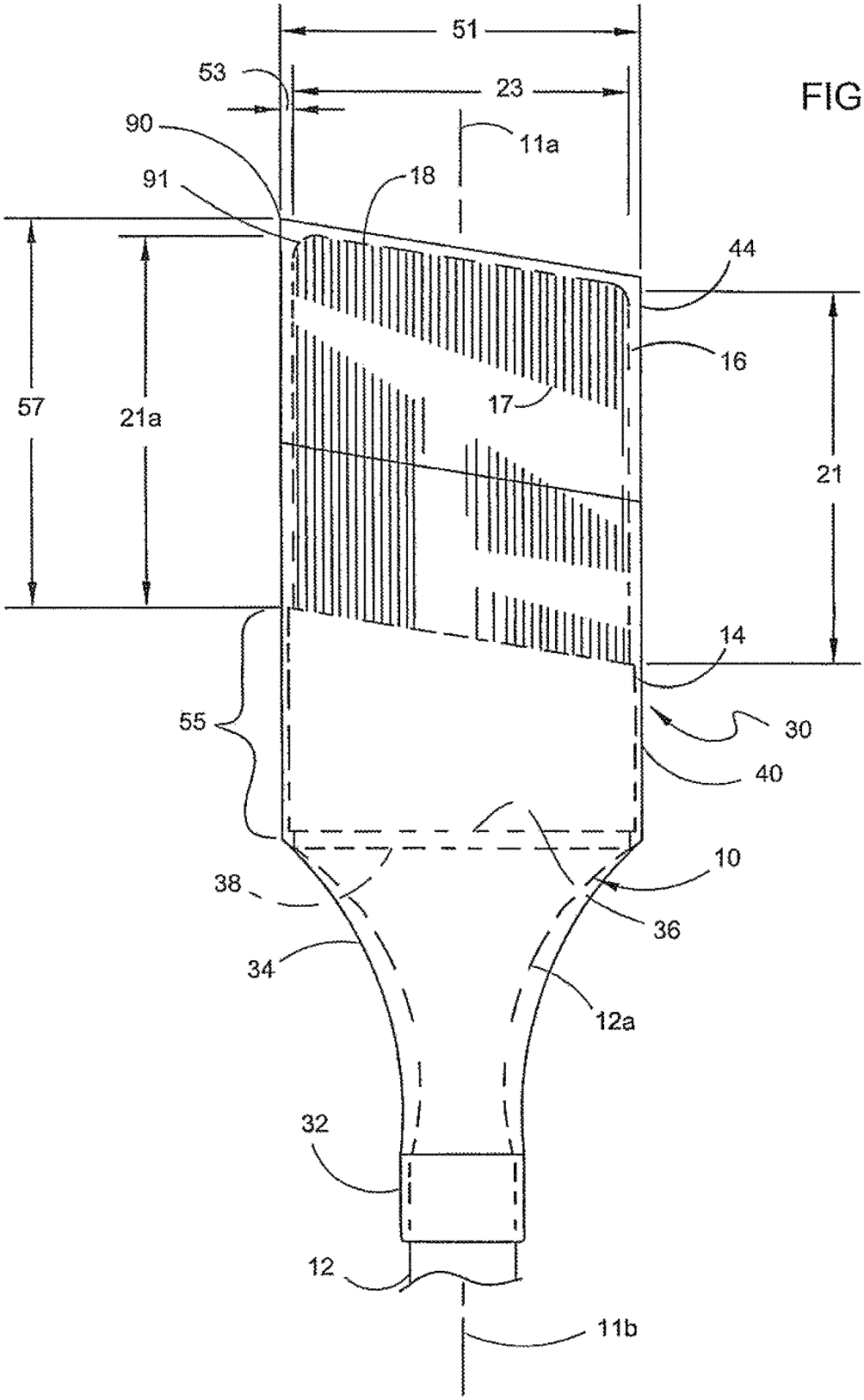
FIG. 1 diagrammatically illustrates one side of the edge tool mounted on a paint brush (the brush body primarily illustrated by dashed lines in FIG. 1 and the bristles partially diagrammatically illustrated therein (not in dashed lines)).
Figure 2A:
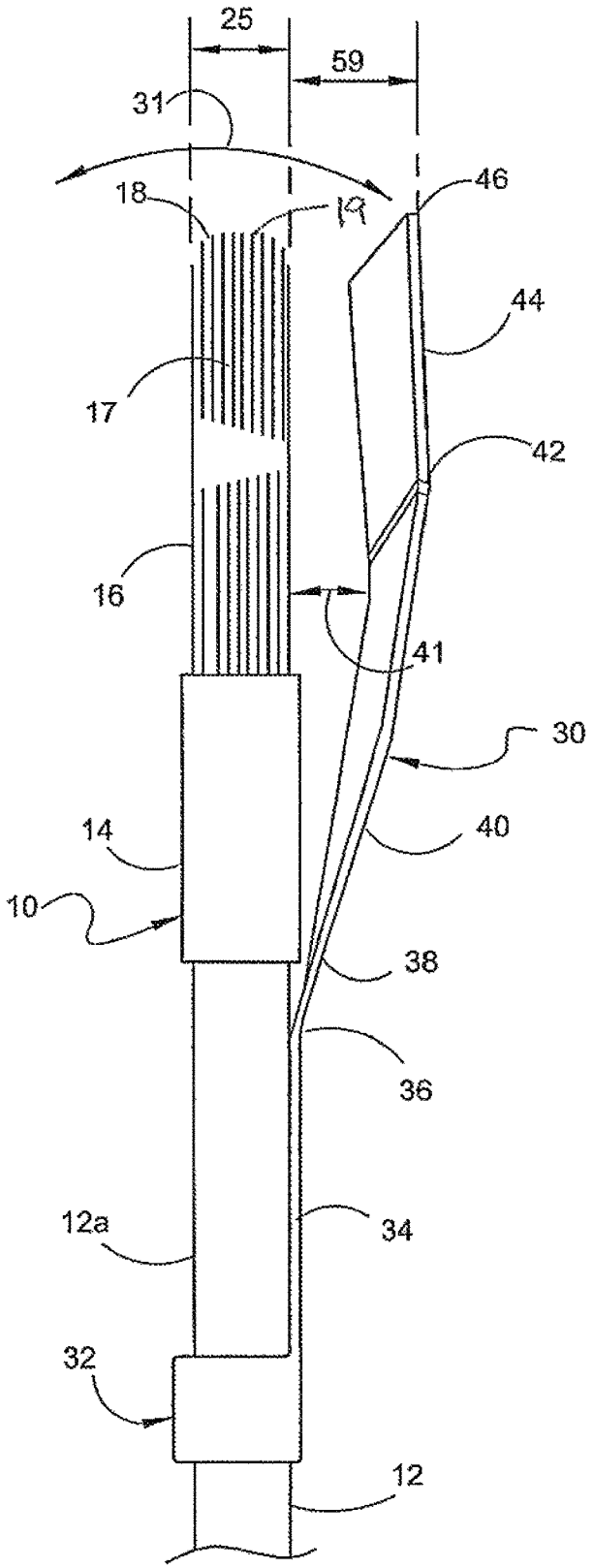
FIG. 2*a* diagrammatically illustrates a left side view of the paintbrush and the mounted edging tool (FIG. 1 being a front view).

FIGS. 1 and 2*a* diagrammatically illustrate a paintbrush 10 and an edging tool 30 removably mounted on paint brush handle 12. FIGS. 1 and 2*a* are discussed concurrently herein.

Paint brush 10 includes a handle 12 and a handle transitional segment 12*a* leading longitudinally to bristle box 14. A plurality of paint brush bristles 17 (diagrammatically partly illustrated in the Figures) extend both longitudinally and laterally outboard beyond bristle box 14 as well as handle 12, 12*a*. Additionally, bristles 17 extend laterally from bristle box 14 to form a three-dimensional (3-D) solid bristle brush plane. FIG. 1 shows that paint brush 10 has a longitudinal axis 11*a*-11*b*.

In FIG. 1, the majority of paint brush 10 is shown in dashed lines because the paint brush edging tool 30 covers a substantial portion of paint brush 10 when viewed from the perspective shown in FIG. 1. In FIG. 2*a*, paint brush edging tool 30 is shown primarily elevated above a majority of paint brush 10, that is, elevated above bristle box 14 and 3-D bristle brush plane 16. The three-dimensional solid 3-D plane 16 is made of a plurality of bristles 17. These bristles have distal terminal end 18. The terms "distal" and the complementary term "proximal" refer to items either farther away from handle 12 or closer to handle 12, respectively. Therefore bristle brush terminal end 18 is at a distal position away from handle 12 as compared with bristle box 14 which is in a proximal location to handle 12 as compared with the location of terminal end 18.

Paint tool 30 includes, at its proximal end, an attachment member 32 which permits the tool to be removably attached to handle 12 of paint brush 10. Attachment systems are discussed later in FIGS. 3*a*, 3*b* and 4-6. The tool is a paint guide for the user. The tool is a guide 30 that enables the user to paint a straight edge at the interface between two adjoining wall surfaces or at the interface between a wall and a molding. The tool 30 has a stabilization plate 34 that is disposed substantially on and adjacent handle segment 12*a*. Plate 34 stabilizes the guide tool 30 on the paint brush handle 12 and prohibits the guide from rolling in an angular manner with respect to axial line 11*a*-11*b* and hence rolling with respect to brush bristles 17. Stabilization plate 34 is proximal to and adjacent the interface between handle 12, 12*a* and bristle box 14. Plate 34 may extend over the bristle box 14.

In one embodiment, the tool guide 30 includes a lateral, substantially perpendicular riser wall (not shown) which elevates a first elevated plate 40 above the stabilization plate 34 and the riser wall is perpendicular to the plane of plate 34. In another embodiment shown in the Figures, the first elevated plate 40 rises above the 3-D bristle plane 16 at an acute angle, about 15 degrees and rises above the stabilization plate 34 (plate 34 being adjacent to the brush handle and bristle box) and the first elevational plate is rotated about 30 degrees about the 3-D axial centerline 11*a*, 11*b*. In this manner, one lateral edge of plate 34 is nearer to the 3-D plane and the other lateral edge of plate 34 is farther away from the 3-D plane.

The first elevated plate 40 extends longitudinally beyond the distal end region of stabilization plate 34 and the proximal longitudinal region 38 of plate 40 is very near and sometimes adjacent the bristle brush box 14. The plate 40, with respect to FIGS. 1 and 2*a*, extends away from stable plate 34 and handle 12 and towards terminal brush end 18 and further is rotated about 15-30 degrees about the axial centerline 11*a*,11*b*. This rotation can be thought of as a twist in the guide.

Figure 2B:
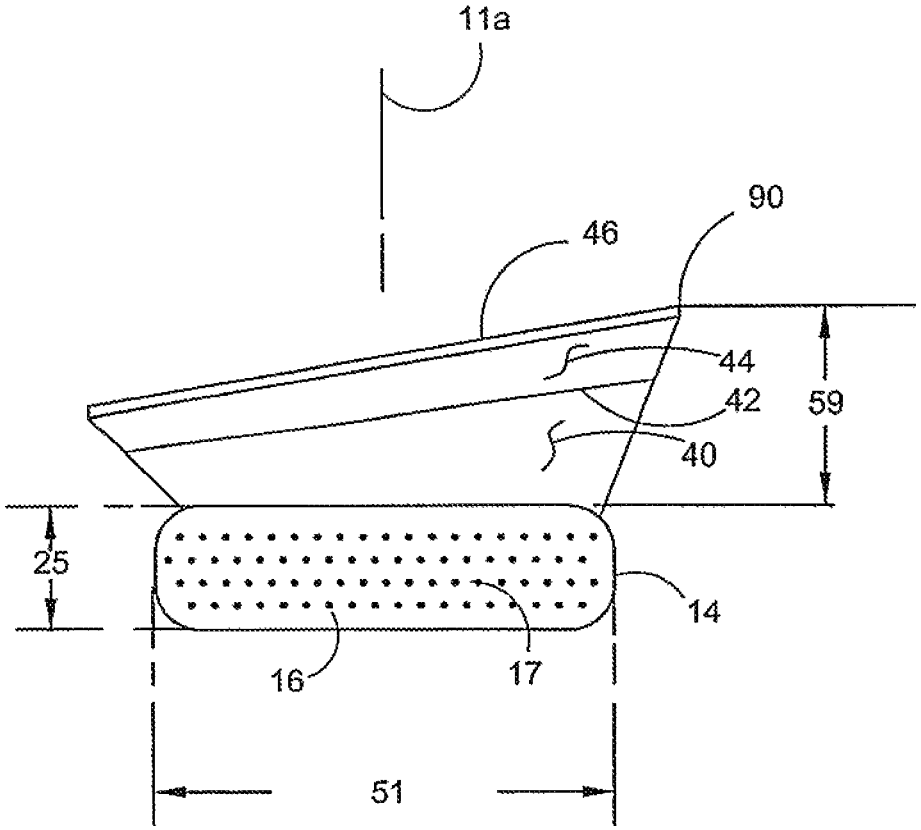
FIG. 2*b* diagrammatically illustrates an end view of the paintbrush, the mounted edging tool and the angular rotated nature of the shield with the two elevated plates.

FIG. 2*b* shows that elevated plate 40 is angularly rotated about 15-30 degrees about the axial centerline 11*a*, 11*b* such that the plate longitudinally rises above the 3D bristle plane but also is rolled at a 15-30 degree angle about the axial centerline 11*a*, 11*b* of the 3D bristle plane.

The elevated plate 40 is disposed at an acute angle away from 3-D brush plane 16 and extends at an angle away from and outboard of 3-D brush plane 16. This acute angle is shown as angle 41 in FIG. 2*a*. In this manner, the edge tool guide 30 is spaced apart from the main body of bristles 17 which forms 3-D brush plane 16. The elevated plate 40 extends outboard and progressively and continuously away from the brush plane 16 such that, at various longitudinal locations, the more distal portions of elevated plate 40 are further and further away from brush plane 16 as those locations are longitudinally spaced farther away from handle 12. Also, the plate 40 is rotated about axial line 11*a*, 11*b*.

The edge guide 30 includes a forward elevated terminal plate 44 (sometime called the second elevated terminal plate 44) which extends beyond the distal interface edge 42 of elevated plate 40. The elevated terminal plate 44 has a distal terminal edge or end 46 which extends longitudinally beyond distal terminal edge 18 of 3-D brush plane 16.

The forward or second terminal plate 44 is disposed at an obtuse angle away from the elevated plate 40 such that the distal terminal plate 44 and the edge 46 extends longitudinally beyond the 3-D brush plane 16 and the edge 46 lies substantially adjacent a facing region 19 of 3-D brush plane 16. As shown in FIG. 2*a*, the brush 3-D plane 16 has a thickness 25 and the terminal edge 46 is disposed a distance 59 away from face region 19 of brush plane 16. Shield tip 90 is complementary to brush tip 91 (see FIG. 1).

The forward or second plate has a terminal edge 46 (see FIG. 2*a*) which is cut at a diagonal with respect to axial centerline 11*a*, 11*b* to complement the diagonal cut of the 3D bristle plane 16. See FIG. 1. Further, as shown in FIG. 2*b*, the forward plate 44 is rotated about 15-30 degrees about the axial centerline 11*a*, 11*b* such that the forward-most tip 90 of edge 46 is further away from the 3D bristle plane 16 as compared with the more-proximal edge point 97 of edge 46. FIG. 1 shows tip points 90, 91.

The elevated plate 40 and the terminal plate 44 are adapted to be elevated over and spaced apart from and cover the facing region 19 of the 3-D brush plane 16 and further are rotated about 15-30 degrees with respect to the axial centerline 11*a*, 11*b*. In this manner, a user can gather paint on the 3-D brush plane 16 and more specifically on bristles 17 without placing paint on the forward or second terminal plate 16 and on edge 46.

The lateral span 51 of tool guide 30 is greater than the lateral span 23 of the 3-D brush plane 16. In this manner elevated plate 40 and terminal plate 44 have complementary lateral and longitudinal dimensions which cover all the bristles. By covering 3D plane face 19, paint on bristles 17 do not strike any wall segment that terminal edge 46 of terminal plate 44 strikes. The terminal edge 46 forces bristle end 18 away from the wall striking terminal edge 46.

The bristles are covered a longitudinal distance 21*a*, 21 with the use of plates 40, 44 having a having a brush coverage distance 57. Further, plates 40, 44 are elevated above and both laterally and longitudinally cover the bristle box 14 and 3D brush plane 16 as shown by the combination of longitudinal distances 55, 57 and lateral distance 51. Although FIG. 1 shows that the lateral distance 51 for plates 44 and 40 is slightly larger than the lateral distance 23 of the 3D brush plane 16, the differential space 53 between these two lateral distances is small.

FIG. 1 shows that the terminal bristle brush end 18 is cut at a bias (cut at an angle, diagonally) with respect to the longitudinal centerline 11*a*-11*b*. It is well-known that some paint brushes have bristle ends cut at a bias 18. Other paint brushes have bristle ends 18 that are normal or perpendicular to the longitudinal aspect of the brush. One type of edge guide 30 includes a terminal end 46 that is cut perpendicular to the axis 11*a*, 11*b* wherein the brush end 18 is perpendicular to the longitudinal aspect of the brush, and the terminal edge 46 of terminal plate 44 is also perpendicular to the longitudinal aspect of the brush as well as the guide edging tool 30.

The edging guide tool 30 may have a thin walled interface 42 between elevated plate 40 and terminal plate 44 which interface has thinner wall thickness than the thickness of plate 40 and plate 44. By thinning wall interface 42, this provides an additional flex joint, permitting flexing of the guide end 44, 46, with respect to plate 40. This flex joint 42 is noted by the double headed flex arrow 31 in FIG. 2*a*. FIG. 2*a* shows interface 42 indicating that there is a thin wall region at that interface between plate 44 and plate 40. The flexation assists the use of the edge guide.

In one embodiment, the stabilization plate 34, riser 36, elevated plate 40 and terminal plate 44 are all one piece, as an integral structure. Preferably, guide structure 30 is made of plastic.

The guide edging tool 30 can be attached with many different types of attachment mechanisms, systems or members to handle 12. Handle clips are shown in FIG. 3*b*.

Figure 3B:
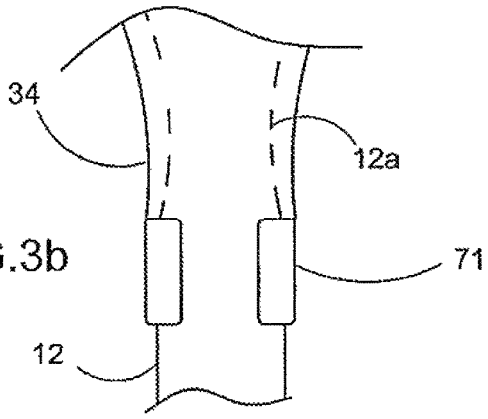
FIGS. 3*a*, 3*b*, 4, 5 and 6 diagrammatically illustrate attachment mechanisms which enable the user to attach the edging tool to the handle of the paint brush.
Figure 3A:
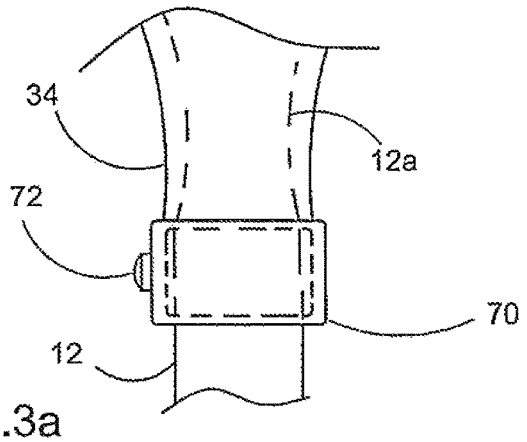
Figure 4:
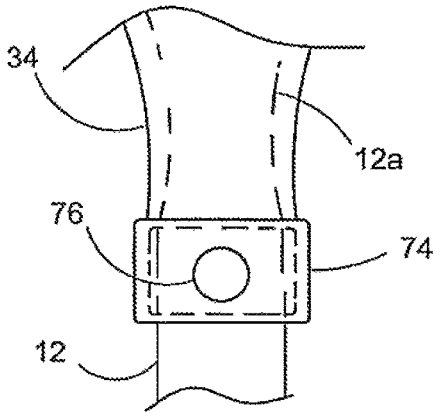
Figure 5:
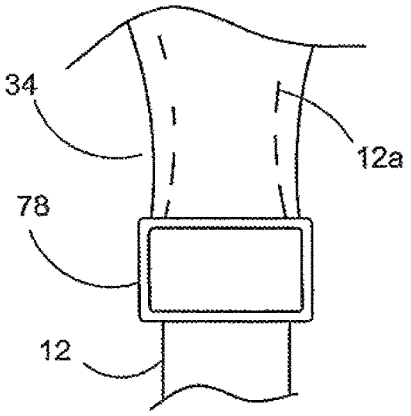

FIGS. 3*a*, 3*b*, 4, 5 and 6 show various types of attachment members. In FIG. 3*b*, attachment member 71 is a clip-on to the brush handle portion 12*a*. In FIG. 3*a*, a wrap around strap 70 includes either a button 72 or a snap to fix the strap to the handle. The wrap around strap 70 may be further attached to a rigid frame in contact with the brush handle 12 such that the strap wraps around the handle and the rigid frame supports the guide plates 40 and 44. In FIG. 4, a snap 76 is utilized for a single wrap attachment system 74. In FIG. 5, attachment system 78 is a multiple wrap-around elastic strap. Returning to FIG. 3*b*, attachment mechanism 71 is a hardware clasp extending partly around the handle. Also, the attachment system may be a clam shell loop-around clasp which closes with a snap hook and catch closure element or may be a clam shell clasp with a snap lock which clasp extends around the handle.

Figure 6:
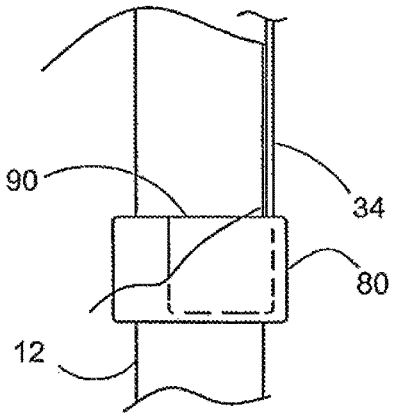

FIG. 6 is a partly broken away view and shows a lateral guide element 190 which is normal to stabilization plate 34 which further stabilizes guide tool 30 on handle 12. Attachment mechanism 80 wraps around lateral guide element 190 as well as handle 12.

Figure 7A:
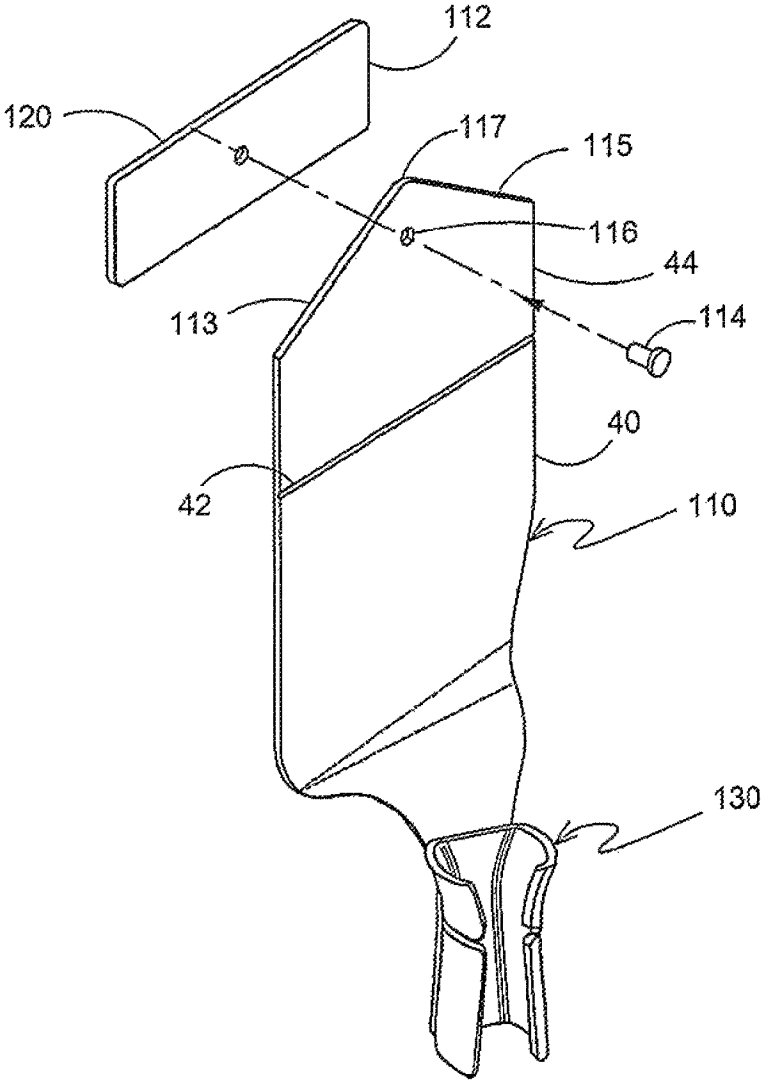
FIG. 7A diagrammatically illustrates a paint brush guide with a swivel mounted secondary guide plate at a terminal end of the first and second elevated plates.
Figure 7B:
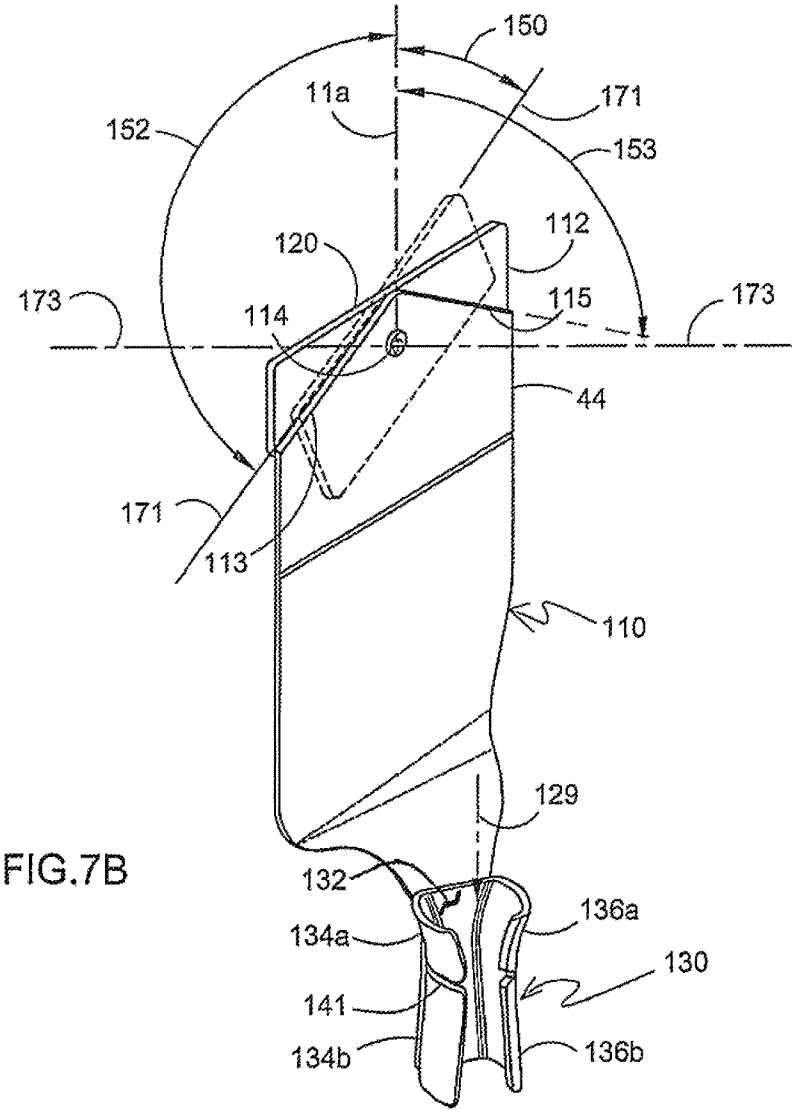
FIG. 7B diagrammatically illustrates the secondary guide plate in a squared off position and in one of two extreme obtuse positions relative to the longitudinal centerline of the paint brush guide.

FIG. 7A diagrammatically illustrates a paint brush guide with a swivel mounted secondary guide plate at a terminal end of the first and second elevated plates 40, 44 (mainly at the distal edge of plate 44). FIG. 7B diagrammatically illustrates the secondary guide plate in a squared off position and in one of two extreme obtuse positions relative to the longitudinal centerline of the paint brush guide. Both figures are discussed concurrently herein. Paint brush guide 110 has a swivel mounted secondary guide plate 112 mounted in the end region of the second elevated plate 44. As discussed earlier, a hinge 42 separates the first elevated plate 40 from the second elevated plate 44. A clip-on system 130 is at the proximal end of the paint brush guide 110.

In the illustrated embodiment, the elevated plate 44 has a distal terminal ends 113, 115 forming a vertex terminating in a pointed distal edge 117. Near the distal end point 117, a swivel mount for the secondary guide plate 112 permits guide plate 112 to swivel to the left and to the right of the second elevated plate 44. A simple swivel mount such as a rivet 114 extending through a hole 116 can be used. Alternatively, a cotter pin or other pin and hole combination may be used, or a screw system or a nut and screw system. As shown, the pin 114 has a shaft extending from secondary guide 112 with a longitudinal gap formed in the shaft of the pin permitting the shaft to collapse on and occupy a smaller cross-sectional area as compared to the cross-sectional area of the pin shaft at rest. A small head at the distal end of the pin shaft can be forced through hole 116 and the split shaft collapses during insertion. After insertion the split shaft returns to its larger cross-sectional shape, thereby locking the plate 122 onto plate 44. Secondary guide plate 112 includes a distal terminal edge 120.

FIG. 7B diagrammatically shows secondary guide plate 112 being positioned at a right angle compared with longitudinal centerline 11*a* of the paint brush. Line 11*a* passes through the paint brush centerline. The longitudinal centerline is shown in FIGS. 1 and 2B.

In one embodiment, the edging guide has a second elevated plate 44 with two distal terminal edges 113 and 115 which edges form an acute angle with respect to each other (a vertex). The swivel mounted secondary guide plate 112 can rotate such that the distal edge 120 of the guide plate 112, that is terminal edge 120, is adjacent the terminal edge 113 of elevated plate 44. This position is shown along line 171 in FIG. 7B. When edges 113, 120 are coextensive, the paint guide is at an extreme obtuse angle 152 with respect to the longitudinal centerline 11*a* of the paint brush. In FIG. 7B, coextensive edges 113, 120 are angularly positioned at a combined angle 152, 150. In the opposite position when swivel guide plate 112 is rotated such that terminal edge 120 is adjacent terminal edge 115 of the second elevated plate 44, the guide forms a second extreme obtuse angle 153. Swivel guide plate 112 rotates about axis 173. The second extreme obtuse angle 153 is measured between longitudinal centerline 11*a* and the imaginary extension line (shown as a dashed line) from edge 115 wherein edge 120 is coextensive with edge 115.

In this manner, the edging tool or paint guide has a swivel end plate which permits the user to easily cut in a painted edge from different brush-to-wall angles. Holding the inventive paint brush in one's right hand and to paint an edge between a vertical sidewall and a ceiling, when the sidewall is adjacent the user's left shoulder, the swivel end plate is placed in one extreme obtuse cut-in angle (a first extreme obtuse cut-in angle 152 which presents edges 120, 113 the to the wall or ceiling an extreme acute guide edge (the variable angle, forward terminal edge of the guide 110)). When the sidewall is adjacent the user's right shoulder, the swivel end plate 112 can be placed in the other extreme obtuse cut-in angle along line 173 (defined by coextensive edges 115 and 120)(presenting to the wall or ceiling the second extreme acute guide edge 115, 120 with the variable angle forward terminal edge of the guide 110).

Figure 9B:
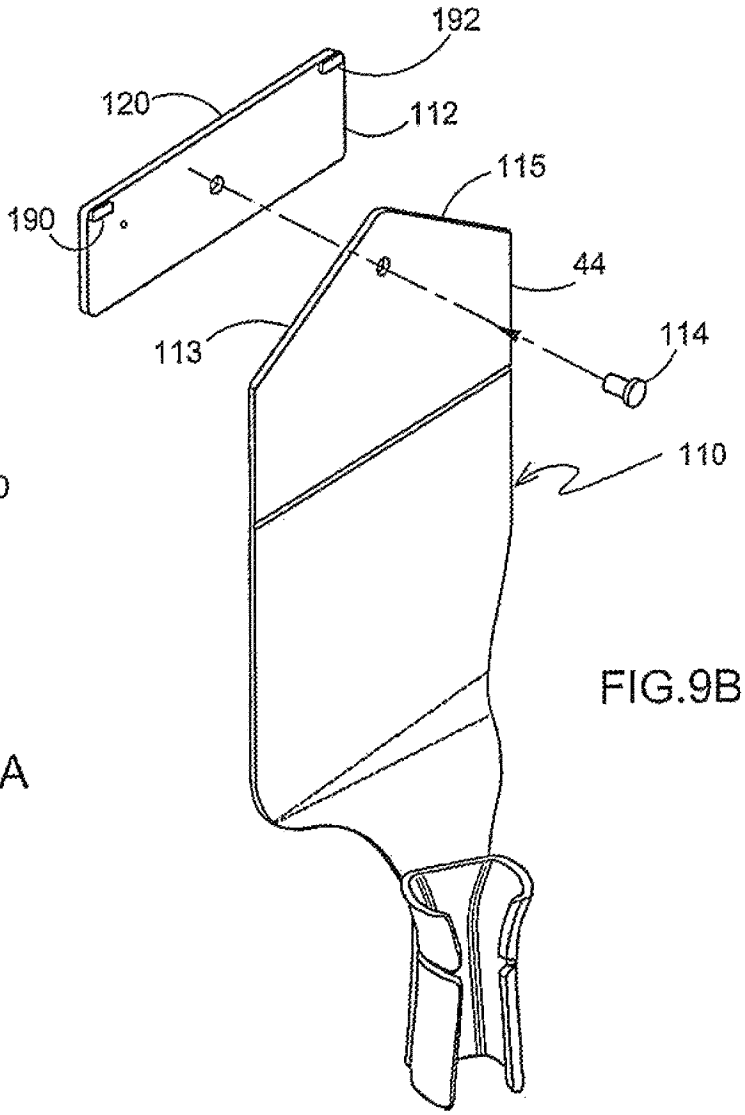
FIG. 9B diagrammatically illustrates other types of mechanical stops for the secondary guide plate.
Figure 9A:
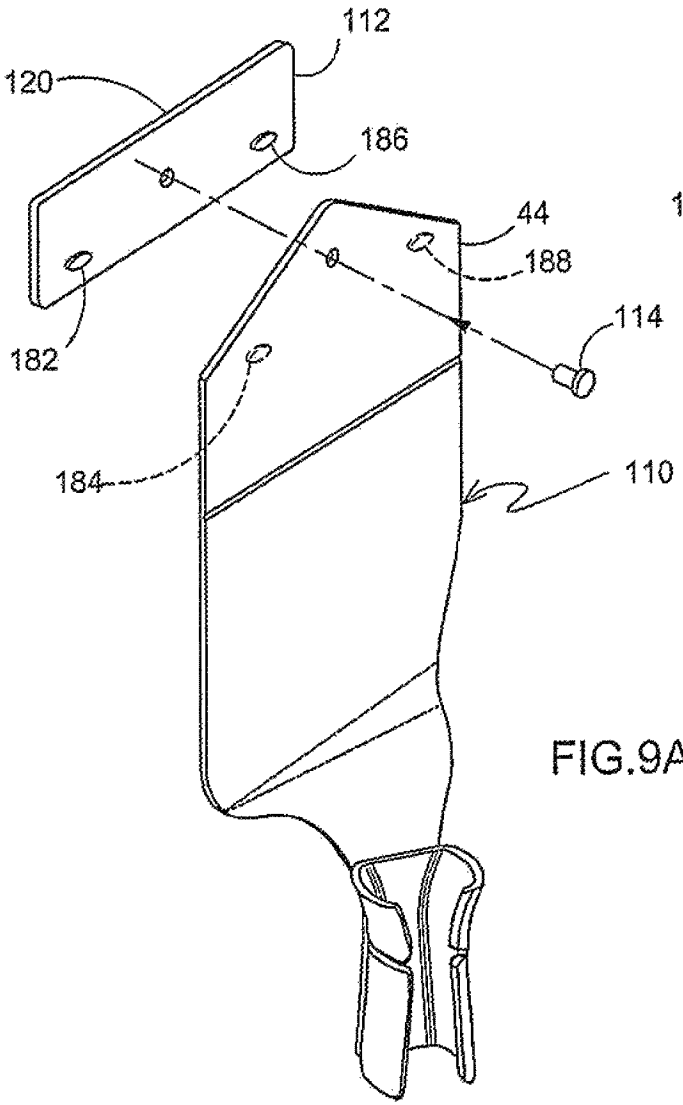
FIG. 9A diagrammatically illustrates one stop system as a pair of mechanical stops for the swivel mounted secondary guide plate.

The variable angle cut in edge can be created by using a series of mechanical stops similar to that shown in FIG. 9A. FIG. 9A diagrammatically illustrates one stop system as a pair of mechanical stops for the swivel mounted secondary guide plate. FIG. 9B diagrammatically illustrates another type of mechanical stops for the secondary guide plate.

With respect to the variable angle cut in edge, rather than using a single indent-detent shown in FIG. 9*a* (for example, protruding hemispherical detent 182 cooperating with intent 184 (in the same regarding detents 186, 188)), a series of detents can be serially located at strategic positions on the outboard or exposed side of second elevated plate 44. The same can be done for the right side protruding detent 186 by adding strategically positioned serial detents 188 on the outboard side of second elevated plate 44.

Therefore, returning to FIG. 7B, the extreme obtuse angles 152, 153 are only common cut in angles which the painter would employ. However, the invention can be designed with a number of mechanical stops or other mechanical stop systems to provide a variable cut in edge guide system for the paint brush.

Figure 8:
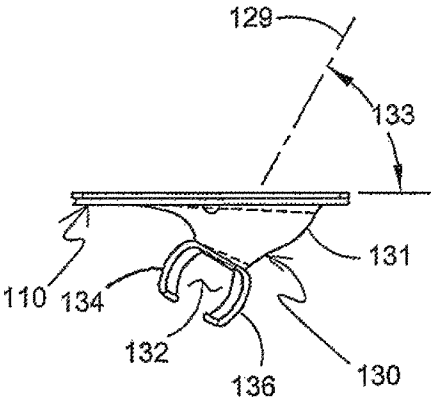
FIG. 8 diagrammatically illustrates a view of a clip-on system for the paint brush guide.

FIG. 8 diagrammatically illustrates a view of a clip-on system for the paint brush guide. Clip system 130 is discussed concurrently with FIGS. 7B and 8. Clip system 130 includes clip jaws 134, 136 that define a space 132 into which is placed the handle of the paintbrush. Clip jaws 134, 136 grab the outside of the paint brush handle and secure the paint edge guide 110 to the handle. Clip jaws 134, 136 are attached to a clip stem 131 which positions the paint edge guide 110 at an acute angle 133 with respect to the longitudinal centerline 129 running through the paint brush. Longitudinal centerline 129 is similar to longitudinal centerline 11*a* in FIGS. 1 and 7B. In general, this angular or twisted position of the guide with respect to the 3-D bristle brush group is shown in FIG. 2B and is discussed above.

The clip 130 shown in FIG. 7B has a split clip jaws system wherein clip jaws segments 134*a* is separated from clip jaw segment 134*b*. The same is true regarding clip jaw segment 136*a* as compared with clip jaw segment 136*b*. A space 141 separates these jaws segments and provides additional stability and additional frictional grip of the guide by the clip on the paint brush handle.

FIG. 9A diagrammatically illustrates one stop system as a pair of mechanical stops for the swivel mounted secondary guide plate. FIG. 9B diagrammatically illustrates another type of mechanical stop for the secondary guide plate. In FIG. 9A, secondary guide plate 112 has a detent system 182, 184 that temporarily locks guide plate 112 in the position shown as extreme obtuse position along line 171 wherein edges 120 and 113 are coextensive. The detent system 186, 188 permits the swivel plate 112 to be temporarily locked into the second obtuse position along line 173 in FIG. 7B wherein guide edge 120 of swivel plate 112 is coextensive with edge 115 of the second elevated plate 44. Various other mechanical stop systems may be utilized. For example, rather than protruding hemispherical elements 182, 186, elements 182, 186 may be ridges with which cooperate with ridges 184, 188 on the outboard side of elevated plate 44. As discussed earlier with the variable angle system, a plurality of ridges would enable the user to change the guide edge 120 to any angle from the right angle of edge 120 shown in FIG. 7B to the first obtuse angle along line 171 (shown in broken lines) or the second extreme obtuse angle along line 173.

In FIG. 9B, mechanical stops 190 and 192 cooperate or coact with edges 113, 115 of the elevated plate 44 thereby causing swivel plate 112 to stop at the first extreme obtuse angle 152 and, at the opposite side, the second of extreme obtuse angle 153. The tabs 190, 192 mechanically stop the swivel at edges 113, 115.

The invention can be configured such that the distal forward edge of elevated plate 44 can be squared off or at a right angle with respect to longitudinal centerline 11*a* (FIG. 7B). This embodiment would use variable angle mechanical stops to position the swivel plate 112 at the desired cut in paint angle.

The claims appended hereto are meant to cover modifications and changes within the scope and spirit of the present invention.

What is claimed is:

1. A paint brush tool adapted to be removably attached to a handle on a paint brush wherein the paint brush has a bristle box longitudinally and laterally extending from the handle and paint brush bristles extending both longitudinally outboard beyond the bristle box and the handle and laterally from the bristle box to form a three dimensional (3-D) solid bristle brush plane about a longitudinal centerline of the paint brush and the paint brush handle, the tool comprising:

a guide having a proximal handle clip or handle strap adapted to be removably attached to said handle, said handle clip or handle strap adapted to removably attach and detach said guide from said handle;

when said guide is attached to said handle via said handle clip or said handle strap:

said guide having a first elevated plate coupled to said handle clip or handle strap and extending longitudinally away from said handle;

said first elevated plate disposed at an acute angle away from said 3-D brush plane and extending at an angle away from and outboard of said 3-D brush plane;

a second elevated plate longitudinally extending beyond a distal edge of said first elevated plate;

a swivel mounted secondary guide plate movably mounted on said second elevated plate at or near both a longitudinal centerline of said second elevated plate and said longitudinal centerline of said paint brush, said secondary guide plate having a distal secondary guide terminal edge;

said secondary guide terminal edge being operable in at least a first and a second guide position, in said first guide position said secondary guide terminal edge forming a first extreme obtuse cut-in angle, and in said second operational position said secondary guide terminal edge forming a second extreme obtuse cut-in angle, said first and second extreme obtuse cut-in angles being relative to said longitudinal centerline of the paint brush and on opposite sides of said longitudinal centerline of the paint brush;

an outboard surface of said second elevated plate disposed at an obtuse angle away from an outboard surface of said first elevated plate such that said second elevated plate extends over said 3-D brush plane and said secondary guide terminal edge in said first and second operational positions is elevated over and spaced apart from a terminal brush facing region of said 3-D brush plane;

said first elevated plate and second elevated plate being longitudinally twisted and rotated at an acute angle with respect to a longitudinal centerline of the 3-D brush plane;

thereby enabling a user to gather paint on said 3-D brush plane and said terminal brush facing region without placing paint on said secondary guide plate.

2. A paint tool as claimed in claim 1 wherein second elevated plate longitudinally extends beyond a distal edge of said first elevated plate, said second elevated plate having a pair of terminal edges forming a terminal vertex above said 3-D brush plane;

said secondary guide plate rotatably mounted near said terminal vertex.

3. A paint tool as claimed in claim 2 wherein a distal endpoint of said vertex is adapted to either (a) be co-extensive with a distal terminal edge of said 3-D brush plane or (b) extend longitudinally beyond said distal terminal edge of said 3-D brush plane.

4. A paint tool as claimed in claim 3 including a hinge along an interface between said first elevated plate and said second elevated plate thereby permitting said second elevated plate to flex with respect to said first elevated plate.

5. A paint tool as claimed in claim 4 wherein said hinge is formed as a detent along said interface between said first elevated plate and said second elevated plate, said detent establishing a flexible joint between said first elevated plate and said second elevated plate.

6. A paint tool as claimed in claim 5 including first and second stops respectively limiting the rotation of said secondary guide plate at (a) said first operational position for said first extreme obtuse cut-in angle and (b) said second operational position at said second extreme obtuse cut-in angle.

7. A paint tool as claimed in claim 6 wherein said first and second stops are disposed on said secondary guide plate and cooperate with said second elevated plate.

8. A paint tool as claimed in claim 1 including first and second stops respectively limiting the rotation of said secondary guide plate at (a) said first operational position for said first extreme obtuse cut-in angle and (b) said second operational position at said second extreme obtuse cut-in angle.

9. A paint tool as claimed in claim 8 wherein said first and second stops are disposed on said secondary guide plate and cooperate with said second elevated plate.

* * * * *